US008131180B2

(12) United States Patent
Ito

(10) Patent No.: US 8,131,180 B2
(45) Date of Patent: Mar. 6, 2012

(54) DEVELOPER CARTRIDGE AND DEVELOPING APPARATUS USING THE SAME, PROCESS CARTRIDGE AND IMAGE FORMING DEVICE USING THE SAME

(75) Inventor: Isao Ito, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 696 days.

(21) Appl. No.: 12/257,007

(22) Filed: Oct. 23, 2008

(65) Prior Publication Data

US 2009/0238600 A1 Sep. 24, 2009

(30) Foreign Application Priority Data

Mar. 21, 2008 (JP) ..... 2008-073805

(51) Int. Cl.
*G03G 15/08* (2006.01)

(52) U.S. Cl. ..... 399/103

(58) Field of Classification Search ..... 399/103, 399/106

See application file for complete search history.

(56) References Cited

U.S. PATENT DOCUMENTS

| | | | | |
|---|---|---|---|---|
| 6,484,000 | B1 | 11/2002 | Ogawa et al. | 399/106 |
| 7,769,317 | B2 * | 8/2010 | Ito | 399/106 |
| 7,826,765 | B2 * | 11/2010 | Kuba | 399/106 |

FOREIGN PATENT DOCUMENTS

| | | |
|---|---|---|
| CN | 1209576 | 3/1999 |
| JP | 07-168444 | 7/1995 |
| JP | 09-026743 | 1/1997 |
| JP | 2001-125357 | 5/2001 |

* cited by examiner

*Primary Examiner* — William J Royer
(74) *Attorney, Agent, or Firm* — Morgan, Lewis & Bockius LLP

(57) ABSTRACT

A developing apparatus includes a housing having an opening that opens towards an image carrier onto which an electrostatic latent image is formed, a developer accommodating unit in which a developer is accommodated, and a continuous charge hole connected with the developer accommodating unit; a developer carrier that carries the developer accommodated in the developer accommodating unit and transports the developer to a developing region in opposition to the image carrier; a sheet member that is provided in the developer accommodating unit and seals a continuous feeding hole; and an insertion hole that is formed in the housing and allows the sheet member to be inserted through when the sheet member is pulled out, wherein the insertion hole has a shape having ends which are more distant from the continuous charge hole than parts of the shape other than the ends.

20 Claims, 9 Drawing Sheets

DEVELOPER CARTRIDGE AND DEVELOPING APPARATUS USING THE SAME, PROCESS CARTRIDGE AND IMAGE FORMING DEVICE USING THE SAME

CROSS-REFERENCE TO RELATED APPLICATIONS

This application claims priority under 35 USC 119 from a Japanese patent application No. 2008-73805 filed on Mar. 21, 2008.

BACKGROUND

1. Technical Field

The present invention relates to a developing apparatus, a process cartridge, an image forming device, and a developer cartridge which are used in an image forming device such as an electronic copying machine or a printer to visualize a latent image on an image carrier.

2. Related Art

In recent years, a large number of recording devices have been available on the market as recording devices to which principles of electrophotography are applied. The recording devices of this type use a cartridge (a so-called process cartridge) which integrates plural members for executing an electrophotographic process. These recording devices have improved operability.

Since there has been a demand for downsizing of recording devices, members forming a part of such a process cartridge have also been downsized. One of these members is a developing apparatus. In the developing apparatus, a developer accommodating unit is formed and is filled with a developer in advance. The developer in the developer accommodating unit is conveyed outside through a continuous hole.

SUMMARY

The present invention provides a developing apparatus, a process cartridge, an image forming device, and a developer cartridge which are capable of preventing a sheet member from being torn off when the sheet member is pulled out and inserted into a continuous hole.

According to one aspect of the invention, there is provided a developing apparatus including: a housing having an opening that opens towards an image carrier onto which an electrostatic latent image is formed, a developer accommodating unit in which a developer is accommodated, and a connecting hole connecting with the developer accommodating unit; a developer carrier that carries the developer accommodated in the developer accommodating unit and transports the developer to a developing region in opposition to the image carrier; a sheet member that is provided in the developer accommodating unit and seals the continuous hole; and an insertion hole that is formed in the housing and allows the sheet member to be inserted through when the sheet member is pulled out, wherein the insertion hole has a shape having ends which are more distant from the connecting hole than parts of the shape other than the ends.

BRIEF DESCRIPTION OF THE DRAWINGS

Exemplary embodiments of the present invention will be described in detail based on the following figures, wherein.

DETAILED DESCRIPTION

1. Exemplary Embodiments

1-1. Overall Structure of Image Forming Device

Figure 1:
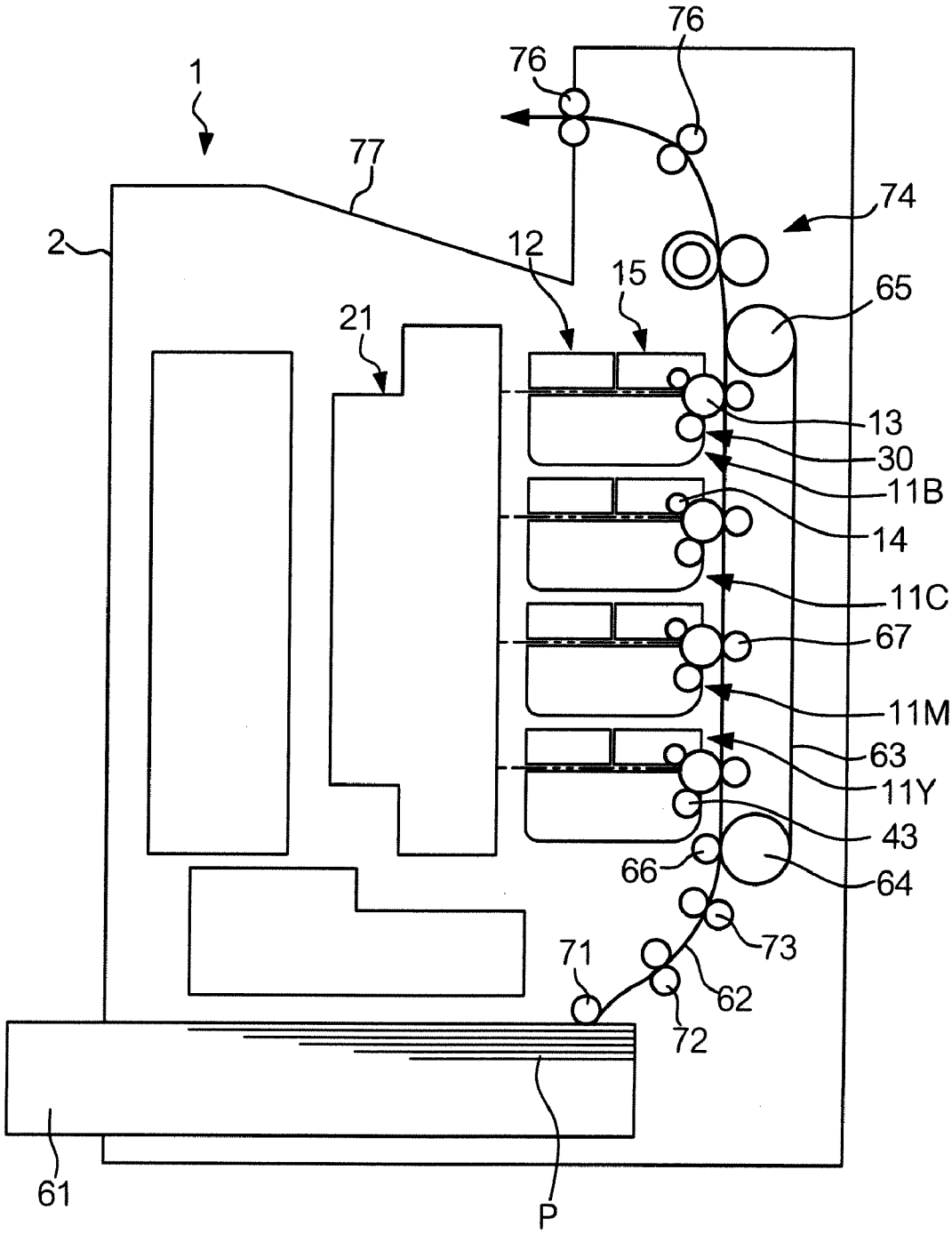
FIG. 1 is a view showing an overall structure of an image forming device according to an exemplary embodiment of the invention.

FIG. 1 shows an overall structure of an image forming device 1 onto which is mounted a developing apparatus 30 according to the invention.

The image forming device 1 according to the exemplary embodiment is a so-called tandem type color image forming device in which image forming units 11 (e.g., 11Y, 11M, 11C, and 11B) for four colors are arranged vertically in a device housing 2. Below the image forming units 11, a sheet feed cassette 61 is provided, and a sheet convey path 62 for paper sheets P from the sheet feed cassette 61 is provided extending vertically through positions corresponding to the image forming units 11.

The image forming units 11 for respectively forming yellow, magenta, cyan, and black toner images are arranged vertically in an order from the upstream side of the sheet convey path 62. Each of the image forming units 11 has a process cartridge 12 and an exposing device 21. Various process units are further incorporated into the process cartridge 12, and the exposing device 21 illuminates the process cartridge 12 with scanning light for image formation.

Each process cartridge 12 integrally holds a photosensitive drum 13, a charge roll 14, a developing apparatus 30, and a cleaning device 15. The charge roll 14 electrically charges the photosensitive drum 13 in advance. The developing apparatus 30 develops an electrostatic latent image with a corresponding color toner (for example, polarized negatively in this embodiment), wherein the electrostatic latent image is exposed and formed on the charged photosensitive drum 13. The cleaning device 15 removes a wasteful toner on the photosensitive drum 13.

The exposing device 21 has a case which contains a semiconductor laser not shown, a polygon mirror, an imaging lens, and a mirror. Light from the semiconductor laser is deflected for scanning the photosensitive drum 13 by the polygon mirror so that a light image is guided to an exposing point on the photosensitive drum 13.

Further, a conveyor belt 63 which circulates along the sheet convey path 62 is provided through positions of the image forming units 11 respectively corresponding to the photosensitive drums 13. The conveyor belt 63 is made of a belt material (rubber or resin) which can electrostatically suction a paper sheet P, and be wound around a pair of tension rolls 64 and 65.

At an inlet portion (facing a tension roll 64) of the conveyor belt 63, there is provided a paper sheet suction roll 66. A high suction voltage is applied to the paper sheet suction roll 66, thereby to suction a paper sheet P onto the conveyor belt 63. Further, a transfer roll 67 is provided on the rear side of the conveyor belt 63 corresponding to the photosensitive drum 13 of each of the image forming units 11. The photosensitive drums 13 are respectively put in tight contact with the transfer rolls 67. Further, a predetermined transfer bias is appropriately applied between the transfer roll 67 and the photosensitive drum 13 by a transfer bias power supply.

Near the sheet feed cassette 61, there is provided a pickup roll 71 which rolls out a paper sheet P at a predetermined timing to transfer positions by conveyor rolls 72 and registration rolls 73.

A fixing device 74 is provided on the sheet convey path 62 and positioned in a further downstream side of the image forming unit 11B which is provided in the most downstream side among the image forming units 11. In the more downstream side of the fixing device 74, there are provided plural sheet output rolls 76 to output paper sheets P. Paper sheets which are output are put on a container tray 77 formed above the device housing 2.

In the image forming device 1 configured as described above, images are formed through a process as follows.

In each of the image forming units 11 (11Y, 11M, 11C, and 11B), the photosensitive drum 13 is electrically charged by the electric charge roll 14, and a latent image is formed on the photosensitive drum 13 by the exposing device 21. Thereafter, a visible image (toner image) is formed by the developing apparatus 30.

Meanwhile, a paper sheet P is output from the sheet feed cassette 61 at a predetermined timing by the pickup roll 71 and fed to a suction position on the conveyor belt 63 through the conveyor rolls 72 and registration rolls 73. The paper sheet P is then fed to transfer positions, kept suctioned to the conveyor belt 63.

Toner images on the photosensitive drums 13 in the image forming units 11 are transferred sequentially to the paper sheet P. Unfixed toner images of individual color components on the paper sheet P are fixed to the paper sheet P by the fixing device 74. The paper sheet P subjected to a fixing process is then output onto the container tray 77.

1-2. Outline of Process Cartridge

The process cartridge 12 has a photosensitive drum 13, an electric charge roll 14, a developing apparatus 30, a cleaning device 15, and the like.

1-3. Outline of Developing Apparatus

Figure 2:
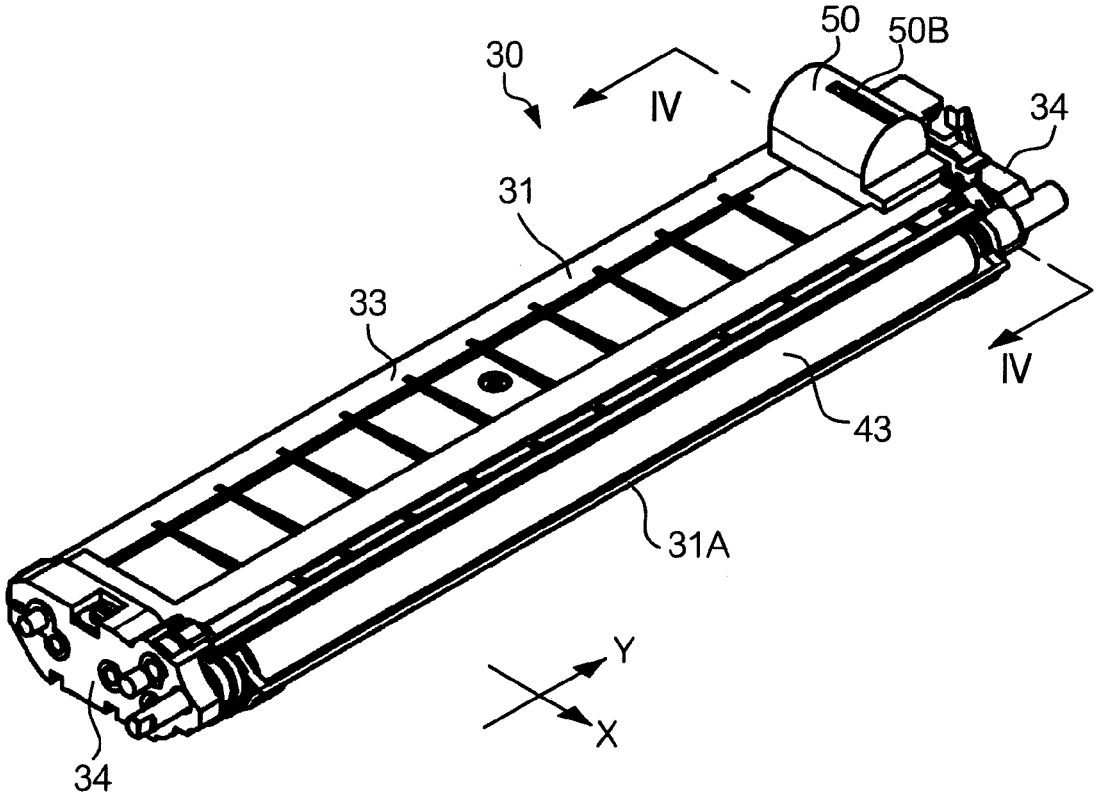
FIG. 2 is a perspective view showing a developing apparatus according to the exemplary embodiment.
Figure 3:
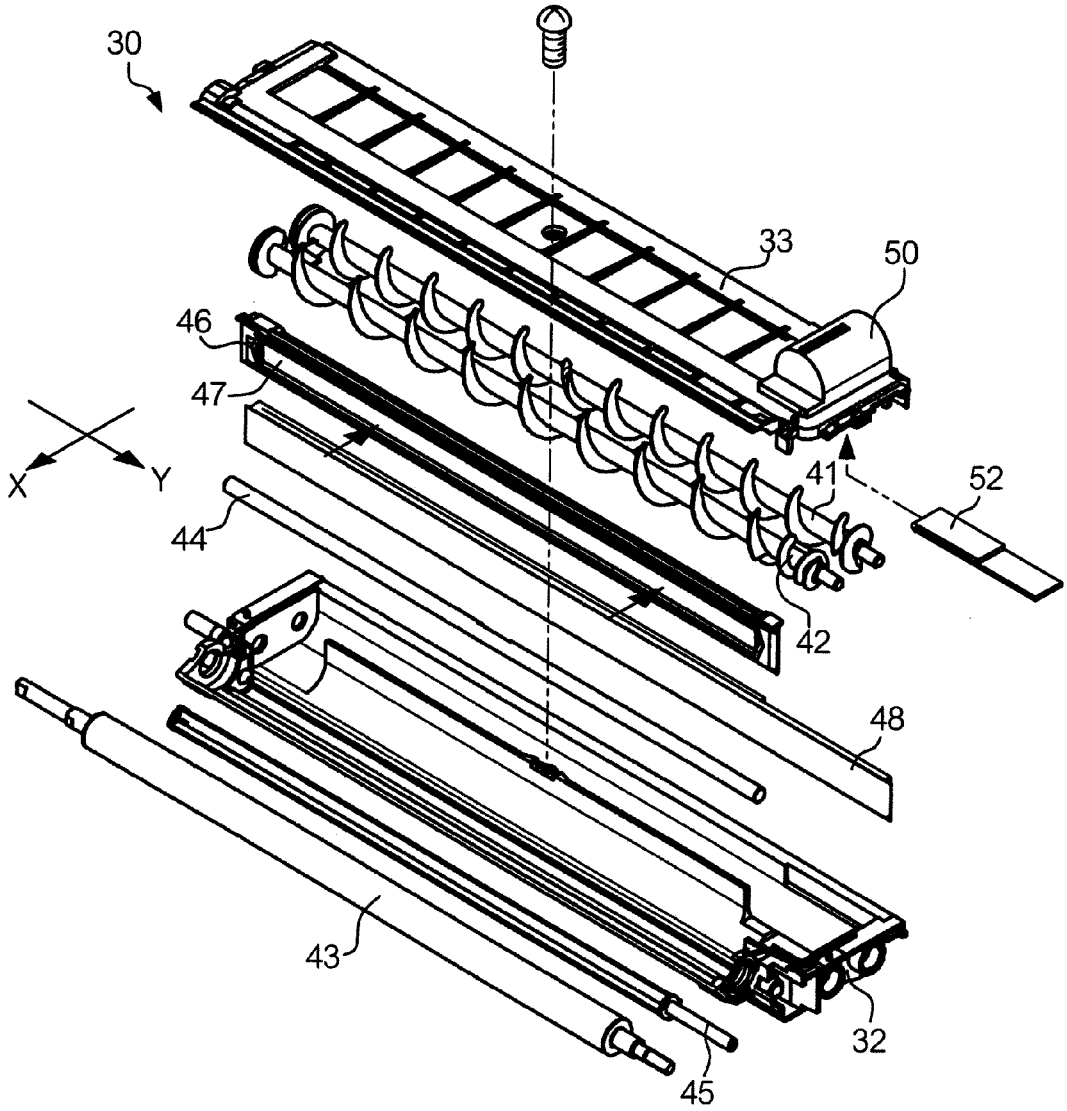
FIG. 3 is an exploded perspective view showing a main part of the developing apparatus according to the exemplary embodiment.
Figure 4:
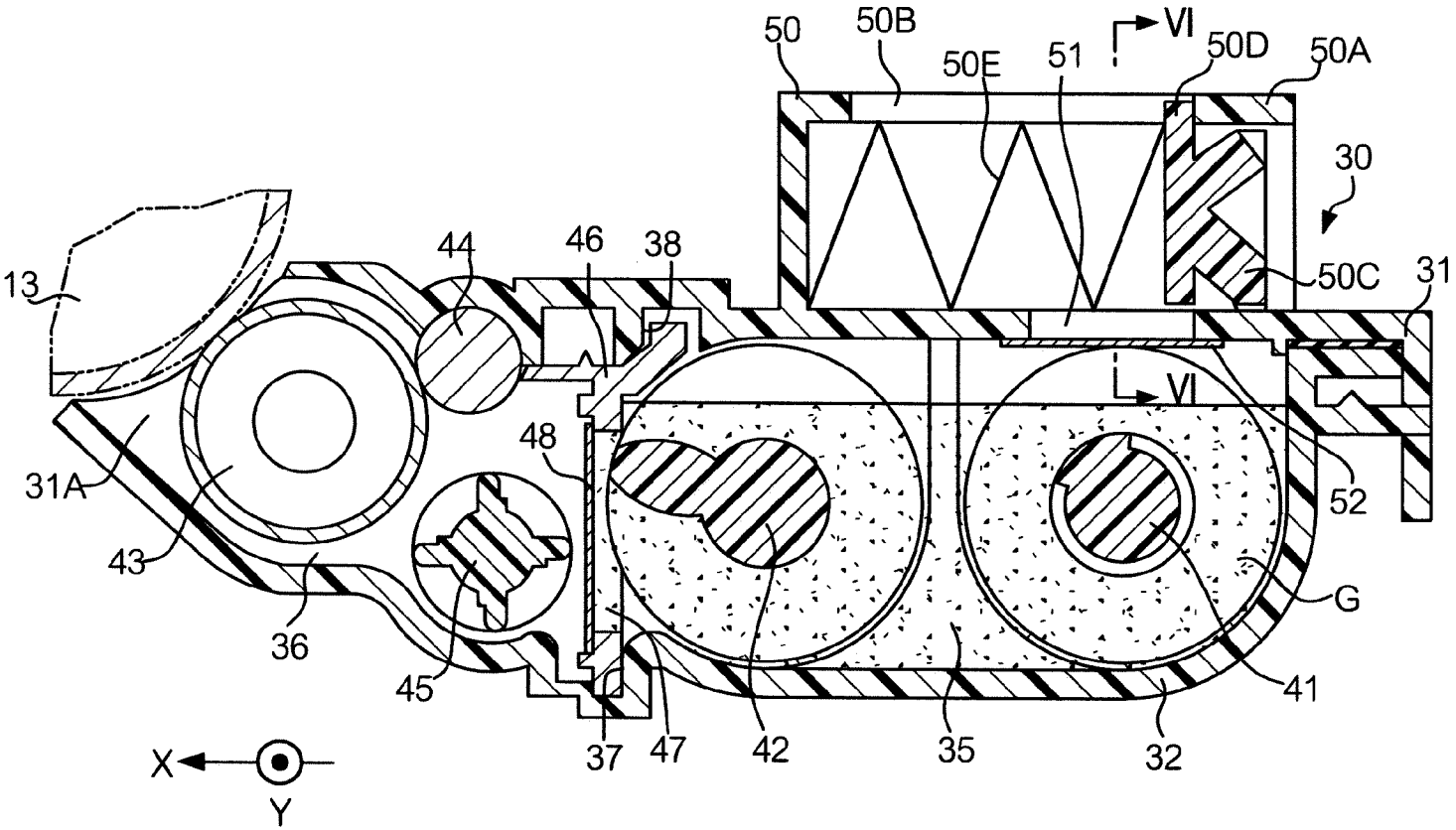
FIG. 4 is a partial cross-sectional view cut along arrows IV in FIG. 2.

FIGS. 2 to 4 show the developing apparatus 30 according to this exemplary embodiment.

FIG. 2 is a perspective view of the developing apparatus 30. FIG. 3 is an exploded perspective view of a main part of the developing apparatus 30. FIG. 4 is a cross-sectional view cut along arrows IV in FIG. 2. In the description made below, lateral and lengthwise directions of the developing apparatus are respectively defined as X and Y axes.

The developing apparatus 30 has: a housing 31 including an opening 31A and a chamber which is partitioned into a developer accommodating unit 35 and a developing part 36; an agitation auger 41 and a supply auger 42 which are provided in the developer accommodating unit 35; and a magnetic roll 43, a trimmer member 44, and a paddle 45 which are provided in the developing part 36.

A part of the magnetic roll 43 is exposed to the outside through the opening 31A and is positioned close to the photosensitive drum 13. The trimmer member 44 regulates an amount of developer which is carried by the surface of the magnetic roll 43. After completion of development, a remaining developer is released from the magnetic roll 43 and is returned to the side of the supply auger 42. Further, torque from one identical drive source is transmitted through gears to the agitation auger 41, supply auger 42, and paddle 45, which are driven to rotate accordingly.

The housing 31 is constituted of a lower housing 32, an upper housing 33, and left and right side covers 34. The housing 31 which is formed by assembling the parts 32 to 34 is partitioned into the developer accommodating unit 35 and the developing part 36 by a partition frame 46. A developer G is filled into the developer accommodating unit 35.

In the housing 31, grooves are formed at a boundary between the developer accommodating unit 35 and the developing part 36, as shown in FIG. 4. The grooves are a lower groove 37 formed in the lower housing 32 and an upper groove 38 formed in the upper housing 33. Parts of the grooves which extend out and formed in the side covers 34 are omitted from the figures. The partition frame 46 to which a seal member is bonded is engaged in these grooves during an unused state.

A developer receiver part 50 which will be described later is formed at one end in the lengthwise direction of the upper housing 33.

The partition frame 46 and a seal member 48 will now be described based on FIG. 5.

Figure 5:
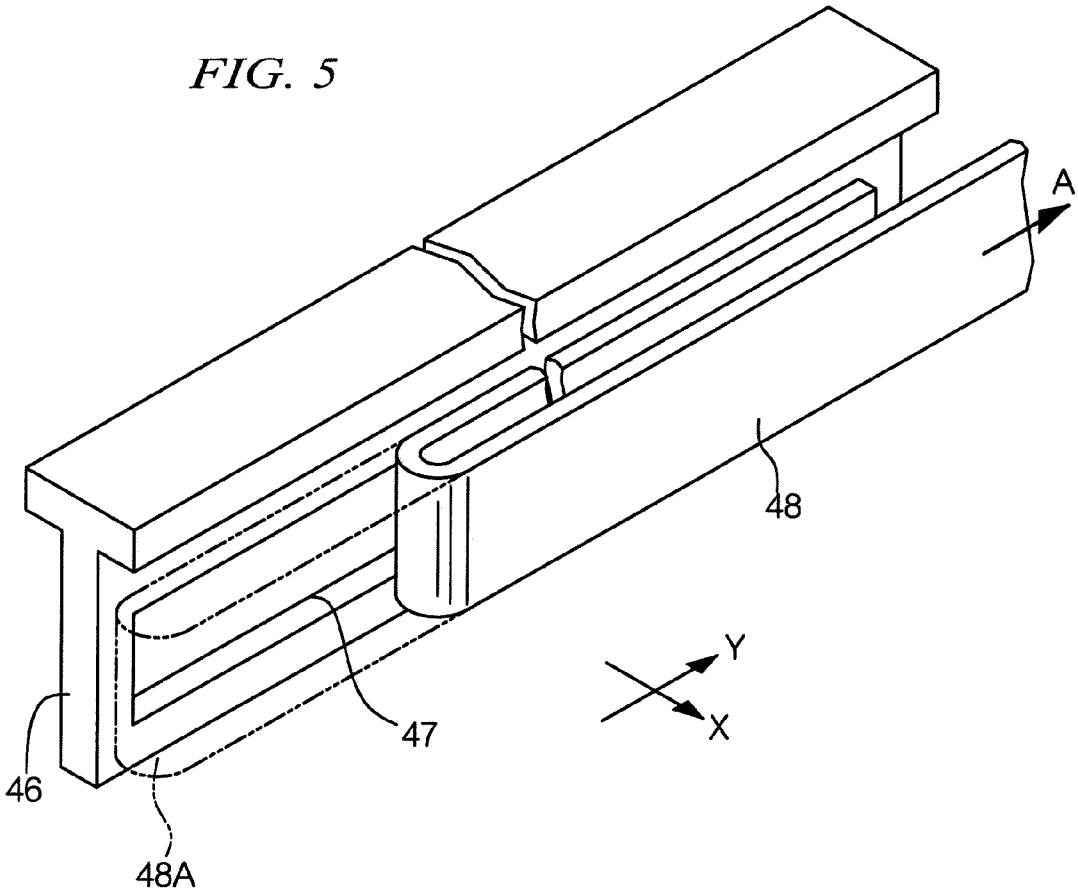
FIG. 5 is a perspective view showing a partition frame and a seal member.

FIG. 5 shows a relationship between the partition frame 46 and the seal member 48. The partition frame 46 includes a continuous feed hole 47 through which the developer accommodating unit 35 and the developing part 36 communicate with each other. The seal member 48 has an outer periphery which is bonded to a side surface of the partition frame 46, so as to seal the continuous feed hole 47. The seal member 48 is substantially longer by twice or more than the continuous feed hole 47 in lengthwise (Y axis) directions of the partition frame 46 since the seal member 48 extends toward an end in one lengthwise direction of the partition frame 46 and is further folded back so as to extend in the other lengthwise direction. The left end of the seal member 48 in FIG. 5 is a folding part 48A. A part of the seal member 48, which extends from a base end to the folding part 48A, is referred to as a fore part. The other part, which extends from the folding part 48A to a free end of the seal member 48, is a returning part. The free end is drawn to the outside through a seal insertion hole (not shown) formed between the upper housing 33 and the lower housing 32 and through a seal path (not shown) in a side cover 34.

When separating the seal member 48 from the partition frame 46, the free end drawn out of one side cover 34 is pulled in a direction of an arrow A. The fore part of the seal member 48 is thereby gradually peeled off from the front side in the figure, and accordingly, the folded part 48A shifts gradually toward the deep side in the figure. Finally, the seal member 48 is completely peeled off, and the continuous feed hole 47 is opened thereby making the developer accommodating unit 35 and the developing part 36 communicate with each other.

Figure 6:
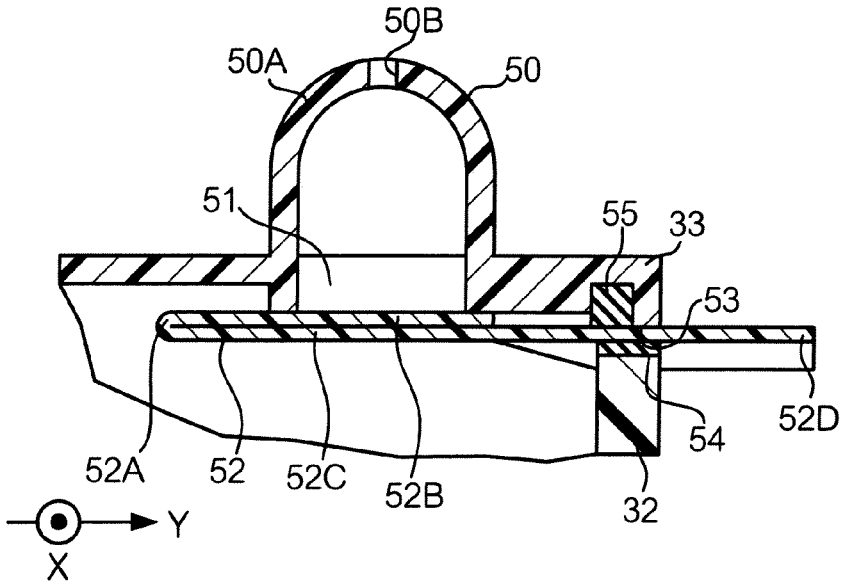
FIG. 6 is a partial cross-sectional view cut along arrows VI in FIG. 4.
Figure 7:
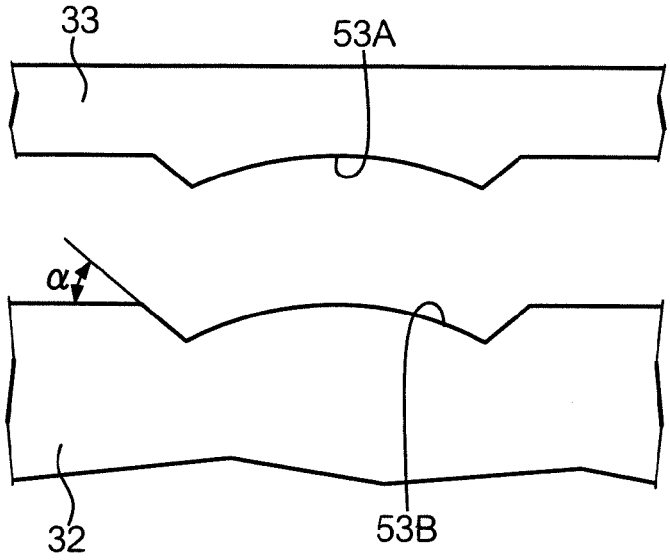
FIG. 7 shows a state before forming a sheet insertion hole.

Next, the developer receiver part 50 will be described with reference to FIGS. 4, 6, and 7. FIG. 6 is a cross-sectional view cut along arrows VI in FIG. 4. FIG. 7 is a side view of the part shown in FIG. 6.

The developer receiver part 50 has an outer part 50A, a cap part 50C, and a press spring 50E. The outer part 50A is formed in a semi-cylindrical shape on the upper housing 33, and has a long regulation hole 50B which is cut in the outer part 50A so as to extend in a lengthwise direction (X axis direction) of the outer part 50A. The cap part 50C slides inside the outer part 50A and a protrusion 50D is formed on the outer part 50A. The press spring 50E presses the cap part 50C in a direction of shutting the cap part 50C. A continuous charge hole 51 is cut in the upper housing 33 at a position where the developer receiver part 50 is formed.

Next, a relationship between the developer receiver part 50 and the seal member 48 will be described. A seal member 52 has an outer periphery which is bonded to an inner side surface of the upper housing 33, so as to seal the continuous charge hole 51. A left end of the seal member 52 in FIG. 6 is a folding part 52A of the seal member 52. A part of the seal member 52, which extends from a base end to the folding part 52A, is referred to as a fore part which is bonded to the periphery of the continuous charge hole 51. The other part of the seal member 52, which extends from the folding part 52A to a free end of the seal member 52, is a returning part. The free end is extended outside through a seal insertion hole 53 formed between the upper housing 33 and the lower housing 32 and through a seal path (not shown) in a side cover 34.

1-4. Features of Exemplary Embodiment

A feature of the developing apparatus 30 according to this embodiment is that the seal insertion hole 53 formed between the upper housing 33 and the lower housing 32 is shaped like an arc. As a result, the ends of the seal insertion hole 53 are more distant from the continuous charge hole 51 than other parts of the seal insertion hole 53. The seal insertion hole 53 is constituted of a concave hole end surface 53A formed on the upper housing 33, and a convex hole end surface 53B formed on the lower housing 32. The hole end surfaces 53A and 53B are coupled with each other thereby forming the arc-like seal insertion hole 53.

Each of ends of the hole end surface 53B formed on the lower housing 32 is chamfered at an angle $\alpha$. The angle $\alpha$ is set to $10° < \alpha < 70°$ (or more desirably $30° < \alpha < 60°$). As a result, a seal member 54 provided on the hole end surface 53B is firmly fixed.

The seal member 54 made of an elastic material is provided for surfaces of the seal insertion hole 53 which are formed by the lower housing 32. A leakage prevention seal member 55 made of an elastic material is provided for surfaces of the seal insertion hole 53 which are formed by the upper housing 33.

Figure 8:
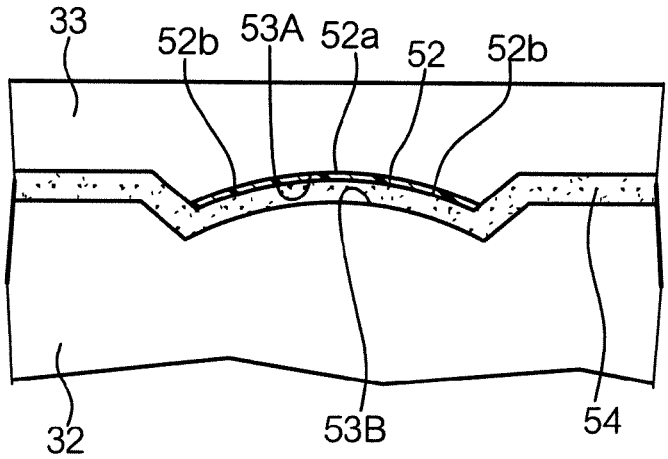
FIG. 8 is a view showing a state in which a sheet member is inserted into the sheet insertion hole.

The seal member 54 is bonded to surfaces including the hole end surface 53A of the lower housing 32, and then, the upper housing 33 and the lower housing 32 are engaged with each other so that the seal member 52 is sandwiched between the hole end surfaces 53A and 53B. In this manner, the seal member 52 has an arc-like cross-section inside the seal insertion hole 53, as shown in FIG. 8.

Figure 9:
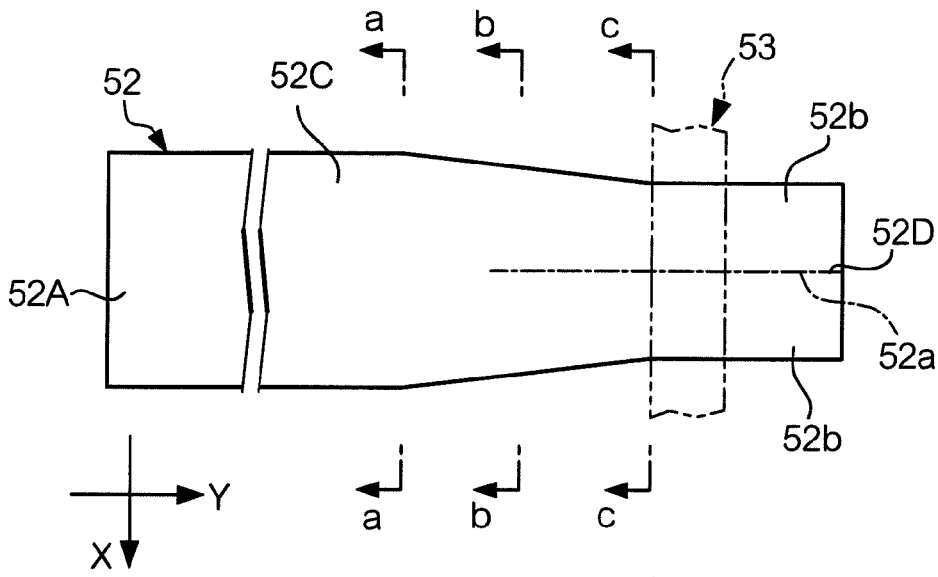
FIG. 9 is a plan view showing a seal member according to the exemplary embodiment.
Figure 10A:
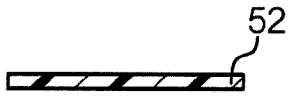
FIGS. 10A, 10B, and 10C are cross-sectional views respectively cut along arrows a, b, and c in FIG. 9.
Figure 10B:
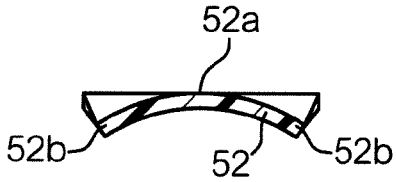
Figure 10C:
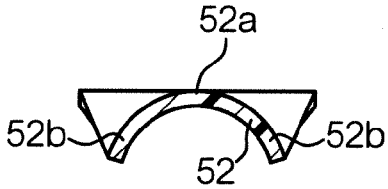

Next, the shape of the seal member 52 inserted into the seal insertion hole 53 will be described with reference to FIGS. 9 and 10. FIG. 9 is a top view of the seal member 52. FIGS. 10A, 10B, and 10C are cross-sectional views respectively cut along arrows a, b, and c. In FIG. 9 and FIGS. 10, an arc-like shape is exemplarily drawn with a smaller radius than an actual radius for the purpose of clearly emphasizing the shape of the seal member 52.

A part of the seal member 52 covering the continuous charge hole 51 is substantially flat since the periphery of this part of the seal member 52 is fixed to the periphery of the continuous charge hole 51. Another part of the seal member 52 which is inserted into the seal insertion hole 53 is shaped like an arc. That is, the returning part 52C of the seal member 52 is substantially flat at a position (e.g., within an area corresponding to the continuous charge hole 51) where a fore part 52B up to the folding part 52A overlaps the returning part 52C. The shape of the seal member 52 becomes gradually arc-like from the position toward the seal insertion hole 53. Therefore, between a position a to a position c, a center line 52*a* as a center in a widthwise direction (X axis direction) is defined on the seal member 52. Slopes 52*b* are formed from the center line 52*a* as a boundary toward two ends in widthwise directions (X axis directions). Further toward the seal insertion hole 53, inclinations of the slopes 52*b* become gradually sharper and closer to inclinations of the seal insertion hole 53 as shown in FIGS. 10B and 10C.

1-5. Effects of Exemplary Embodiment

As has been specifically described above, the shape of the seal insertion hole 53 is formed like an arc. Therefore, the shape of the seal member 52 which seals the continuous charge hole 51 in the developer receiver part 50 gradually changes form into an arc-like shape from the continuous charge hole 51 toward the seal insertion hole 53. In this manner, a developer G which goes into the folding part 52A or goes in-between the seal member 52 and the upper housing 33 is released by being guided along the slopes 52*b* formed on the seal member 52. Accordingly, accumulation of the developer G near the seal insertion hole 53 can be steadily reduced so that the developer G is prevented from accumulating thereby decreasing the resistance to pulling out of the seal member 52. Further, the seal member 52 is prevented from being torn due to such resistance of an accumulative developer G when the seal member 52 is peeled off.

In addition, the slopes of the seal member 52 are formed so that inclinations of the slopes 52*b* become gradually steeper toward the seal insertion hole 53. Accordingly, the developer G accumulates at a position where the seal member 52 has a nearly flat cross-section. Therefore, if the developer G is caught in the seal member 52 as the seal member 52 is pulled out, the developer G moves together with the seal member 52 and is then released along the gradually increasing inclinations of the slopes 52*b*.

As described above, accumulation of the developer G near the seal member 52 is reduced by only a simple change in form of the seal insertion hole 53 into an arc-like shape. In this manner, resistance which is caused by accumulation of the developer G when a user pulls out the seal member 52 by drawing a free end 52D of the seal member 52 is reduced so that the seal member 52 is steadily prevented from being torn. As a result, reliability of the developing apparatus 30 can be improved.

Usually, the developing apparatus 30 is transported with the X and Y axes basically kept horizontal, as shown in FIGS. 2 and 4. Gravitational force therefore acts in the directions toward the ends of the slopes 52*b* from the center line 52*a* (folding curve 52*a*), on the slopes 52*b* where the seal member 52 is formed. Interaction between the gravitational force and formation of the seal member 52 (slopes 52*b*) reduces accumulation of a developer G near the seal member 52. This interaction is particularly effective when the seal member 52 which is formed by the seal insertion hole 53 has a shape in which the ends are positioned at gravitationally lower positions than positions of the other parts of the shape.

Further, the seal insertion hole 53 is provided with the seal member 52 and leakage prevention seal member 55 by which the seal member 52 is maintained pressed. The developer G filled in the developer accommodating unit 35 is prevented from leaking outside.

2. Modifications

2-1. Modification 1

The exemplary embodiment exemplifies a case that the shape of the seal insertion hole 53 in which the seal member 52 is inserted is formed into an arc-like shape in order to change the shape of the seal member 52 which seals the continuous charge hole 51. However, the invention is not limited to this case but the shape of the seal insertion hole 53 in which the seal member 52 for sealing the continuous feed hole 51 may alternatively be formed into an arc-like shape.

2-2. Modification 2

Figure 11:
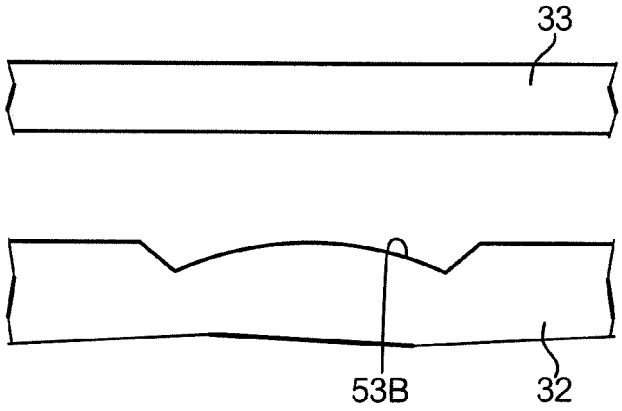
FIG. 11 shows Modification 2.
Figure 12:
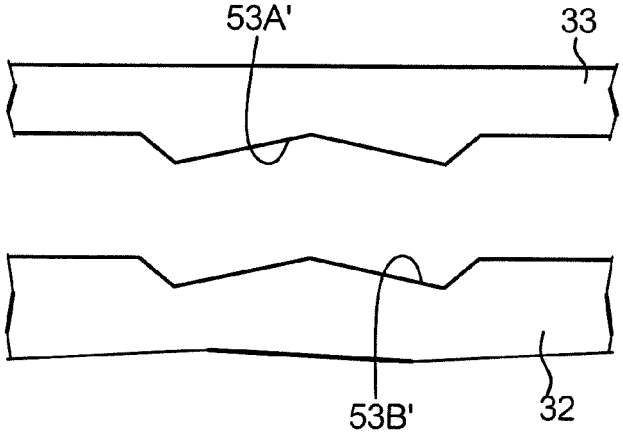
FIG. 12 shows a state before forming a sheet insertion hole in Modification 3.

Also in the exemplary embodiment, the hole end surfaces 53A and 53B are respectively formed on the upper housing 33 and the lower housing 32 in order to form the seal insertion hole 53 into an arc-like shape. However, only one hole end surface may be formed on one of the upper housing 33 and lower housing 32. For example, as shown in FIG. 11, a hole end surface 53B may be formed only on the lower housing 32. In this case, the seal member 52 is pressed against the hole end surface 53B by the leakage prevention seal member 55 provided on the upper housing 33, and the shape of the seal member 52 is accordingly deformed into an arc-like shape.

2-3. Modification 3

The shape of the seal insertion hole 53 is not limited to an arc-like shape but may alternatively be a substantially inverted V-shape. In this case, the shape of the seal member 52 is deformed as shown in FIGS. 12 to 15A, 15B, and 15C.

The seal insertion hole 53 is constituted of a concave hole end surface 53A formed on the upper housing 33 and a convex hole end surface 53B formed on the lower housing 32. The seal insertion hole 53 having a substantially inverted V-shape is formed by engaging the hole end surfaces 53A' and 53B' with each other.

Figure 13:
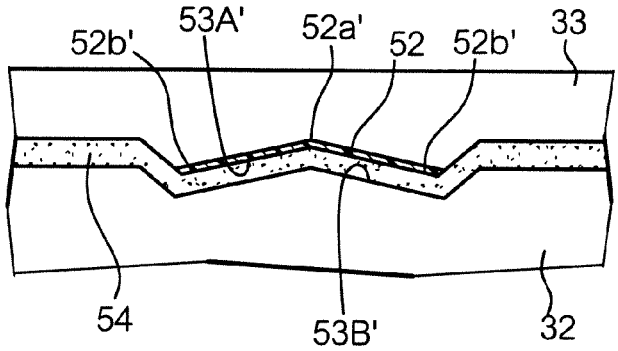
FIG. 13 shows a state in which a sheet member is inserted in a sheet insertion hole in Modification 3.

After bonding a seal member 54 to a surface of the lower housing 32 which includes the hole end surface 53B', the upper housing 33 and the lower housing 32 are fitted to each other so as to sandwich a seal member 52 between the hole end surfaces 53A' and 53B'. As a result, the seal member 52 has a substantially inverted V-shaped cross-section inside the seal insertion hole 53, as shown in FIG. 13.

Next, the shape of the seal member 52 formed by the seal insertion hole 53 having also a substantially inverted V-shape will be described with reference to FIGS. 14 and 15.

Figure 14:
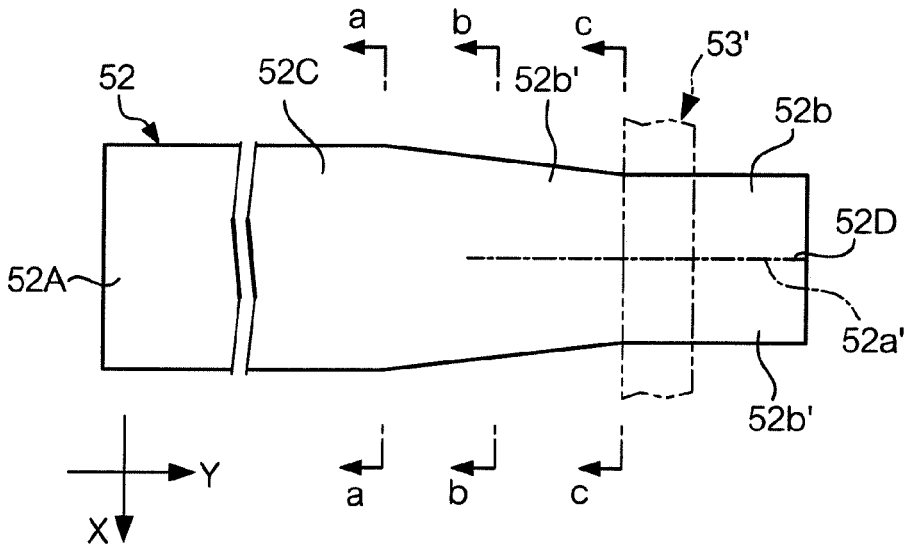
FIG. 14 is a plan view of the seal member in Modification 3.
Figure 15A:
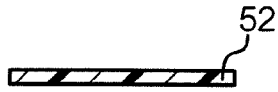
FIGS. 15A, 15B, and 15C are cross-sectional views respectively cut along arrows a, b, and c in FIG. 14.
Figure 15B:
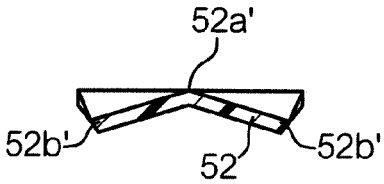
Figure 15C:
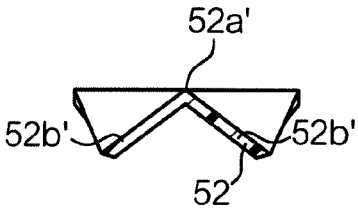

FIG. 14 is a top view of the seal member 52 according to Modification 3. FIGS. 15A, 15B, and 15C are respectively cross-sectional views cut along arrows a, b, and c.

A part of the seal member 52 covering the continuous charge hole 51 is substantially flat since the periphery of this part of the seal member 52 is fixed to the periphery of the continuous charge hole 51. Another part of the seal member 52 which is inserted into the seal insertion hole 53' has an arc-like cross-section. That is, the returning part 52C of the seal member 52 is substantially flat at a position (e.g., within an area corresponding to the continuous charge hole 51) where the fore part 52B up to the folding part 52A overlaps the returning part 52C. The shape of the seal member 52 becomes gradually arc-like toward the seal insertion hole 53'. Therefore, between a position a to a position c, a center line 52*a*' as a center in widthwise directions (X axis directions) is defined on the seal member 52. Slopes 52*b*' are formed extending from the center line 52*a*' as a boundary toward two ends in the widthwise direction (X axis direction). Further toward the seal insertion hole 53', inclinations of the slopes 52*b*' become gradually sharper and closer to inclinations of the seal insertion hole 53' as shown in FIGS. 15B and 15C.

In this manner, the same effects as obtained in the exemplary embodiment can be obtained by the seal member 52 which changes form by the seal insertion hole 53' having a substantially inverted V-shape.

The shape of the seal insertion hole 53' is not limited to a substantially inverted V-shape and an arc-like shape but needs only to satisfy a condition that ends of the seal insertion hole 53' are more distant from the continuous charge hole 51 than other parts of the seal insertion hole 53. In other words, the seal member 52 needs only to have the slopes 52*b*'.

Further, a hole end surface may be formed on only one of the upper housing 33 and the lower housing 32, as in Modification 2.

2-4. Modification 4

The exemplary embodiment as described above is configured so that the shape of the seal member in the developing apparatus 30 is deformed. However, the invention is not limited to this configuration but has a developer accommodating unit such as a toner cartridge but may be applied to a developer cartridge (or developer container) having a developer accommodating unit in which a seal member for sealing a continuous hole is employed.

The foregoing description of the exemplary embodiment of the present invention has been provided for the purpose of illustration and description. It is not intended to be exhaustive or to limit the invention to the precise forms disclosed. Obviously, many modifications and variations will be apparent to practitioners skilled in the art. The exemplary embodiment were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing apparatus comprising:

a housing having an opening that opens towards an image carrier onto which an electrostatic latent image is formed, a developer accommodating unit in which a developer is accommodated, and a continuous hole connecting with the developer accommodating unit;

a developer carrier that carries the developer accommodated in the developer accommodating unit and transports the developer to a developing region in opposition to the image carrier;

a sheet member that is provided in the developer accommodating unit and seals the continuous hole; and an insertion hole that is formed in the housing and allows the sheet member to be inserted through when the sheet member is pulled out, wherein the insertion hole has a plurality of ends and at least one of the plurality of ends is positioned lower than other parts of the insertion hole in a gravity direction, the at least one end being along with a direction that the sheet member is pulled out.

2. The developing apparatus according to claim 1, wherein the insertion hole is formed so that a cross-section of a shape of the insertion hole is a substantially an arc-like shape.

3. The developing apparatus according to claim 1, further comprising a developer leakage prevention member that substantially prevents the developer in the developer accommodating unit from leaking outside is provided near the insertion hole.

4. The developing apparatus according to claim 1, wherein the continuous hole allows the developer accommodating unit to communicate with a side of the opening or allows the developer accommodating unit to communicate with another developer cartridge.

5. The developing apparatus according to claim 1, wherein the sheet member is folded during an unused period, and is constituted of a fore part, a folding part, and a returning part, and the sheet member is provided in the housing in a manner that among the fore part, folding part, and returning part, the folding part is most distant from the insertion hole, the fore part is bonded to the continuous hole, and the returning part has a free end exposed to the outside through the insertion hole.

6. A process cartridge comprising:

an image carrier having a surface onto which an electrostatic latent image is formed;

a housing having an opening that opens towards an image carrier onto which an electrostatic latent image is formed, a developer accommodating unit in which a developer is accommodated, and a continuous hole connecting with the developer accommodating unit;

a developer carrier that carries the developer accommodated in the developer accommodating unit and transports the developer to a developing region in opposition to the image carrier;

a sheet member that is provided in the developer accommodating unit and seals the continuous hole; and an insertion hole that is formed in the housing and allows the sheet member to be inserted through when the sheet member is pulled out, wherein the insertion hole has a plurality of ends and at least one of the plurality of ends is positioned lower than other parts of the insertion hole in a gravity direction, the at least one end being along with a direction that the sheet member is pulled out.

7. The process cartridge according to claim 6, wherein the insertion hole is formed so that a cross-section of a shape of the insertion hole is a substantially an arc-like shape.

8. The process cartridge according to claim 6, further comprising a developer leakage prevention member that substantially prevents the developer in the developer accommodating unit from leaking outside is provided near the insertion hole.

9. The process cartridge according to claim 6, wherein the continuous hole allows the developer accommodating unit to communicate with a side of the opening or allows the developer accommodating unit to communicate with another developer cartridge.

10. The process cartridge according to claim 6, wherein the sheet member is folded during an unused period, and is constituted of a fore part, a folding part, and a returning part, and the sheet member is provided in the housing in a manner that among the fore part, folding part, and returning part, the folding part is most distant from the insertion hole, the fore part is bonded to the continuous hole, and the returning part has a free end exposed to the outside through the insertion hole.

11. An image forming device comprising:

a housing having an opening that opens towards an image carrier onto which an electrostatic latent image is formed, a developer accommodating unit in which a developer is accommodated, and a continuous hole connecting with the developer accommodating unit;

a developer carrier that carries the developer accommodated in the developer accommodating unit and transports the developer to a developing region in opposition to the image carrier;

a sheet member that is provided in the developer accommodating unit and seals the continuous hole; and an insertion hole that is formed in the housing and allows the sheet member to be inserted through when the sheet member is pulled out, wherein the insertion hole has a plurality of ends and at least one of the plurality of ends is positioned lower than other parts of the insertion hole in a gravity direction, the at least one end being along with a direction that the sheet member is pulled out.

12. The image forming device according to claim 11, wherein the insertion hole is formed so that a cross-section of a shape of the insertion hole is a substantially an arc-like shape.

13. The image forming device according to claim 11, further comprising a developer leakage prevention member that substantially prevents the developer in the developer accommodating unit from leaking outside is provided near the insertion hole.

14. The image forming device according to claim 11, wherein the continuous hole allows the developer accommodating unit to communicate with a side of the opening or allows the developer accommodating unit to communicate with another developer cartridge.

15. The image forming device according to claim 11, wherein the sheet member is folded during an unused period, and is constituted of a fore part, a folding part, and a returning part, and the sheet member is provided in the housing in a manner that among the fore part, folding part, and returning part, the folding part is most distant from the insertion hole, the fore part is bonded to the continuous hole, and the returning part has a free end exposed to the outside through the insertion hole.

16. A developer cartridge comprising:

a housing having a developer accommodating unit and a continuous hole, the developer accommodating unit accommodating a developer, and the continuous hole communicating with the developer accommodating unit;

a sheet member that is provided in the developer accommodating unit and seals a continuous hole; and an insertion hole that is formed in the housing and allows the sheet member to be inserted through when the sheet member is pulled out, wherein the insertion hole has a plurality of ends and at least one of the plurality of ends is positioned lower than other parts of the insertion hole in a gravity direction, the at least one end being along with a direction that the sheet member is pulled out.

17. The developer cartridge according to claim 16, wherein the insertion hole is formed so that a cross-section of a shape of the insertion hole is a substantially an arc-like shape.

18. The developer cartridge according to claim 16, further comprising a developer leakage prevention member that substantially prevents the developer in the developer accommodating unit from leaking outside is provided near the insertion hole.

19. The developer cartridge according to claim 16, wherein the continuous hole allows the developer accommodating unit to communicate with a side of the opening or allows the developer accommodating unit to communicate with another developer cartridge.

20. The developer cartridge according to claim 16, wherein the sheet member is folded during an unused period, and is constituted of a fore part, a folding part, and a returning part, and the sheet member is provided in the housing in a manner that among the fore part, folding part, and returning part, the folding part is most distant from the insertion hole, the fore part is bonded to the continuous hole, and the returning part has a free end exposed to the outside through the insertion hole.

* * * * *